US006298883B1

(12) United States Patent
Kinzel

(10) Patent No.: US 6,298,883 B1
(45) Date of Patent: Oct. 9, 2001

(54) CENTRALIZER

(75) Inventor: Holger Kinzel, Peine-Schwicheldt (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/462,512

(22) PCT Filed: Apr. 9, 1998

(86) PCT No.: PCT/GB98/01067

§ 371 Date: Mar. 30, 2000

§ 102(e) Date: Mar. 30, 2000

(87) PCT Pub. No.: WO99/04132

PCT Pub. Date: Jan. 28, 1999

(30) Foreign Application Priority Data

Jul. 15, 1997 (GB) ..... 9715006

(51) Int. Cl.[7] ..... F16L 55/00
(52) U.S. Cl. ..... 138/108; 138/112; 138/155
(58) Field of Search ..... 138/108, 110, 138/112, 155

(56) References Cited

U.S. PATENT DOCUMENTS

| | | | | |
|---|---|---|---|---|
| 3,318,335 | * | 5/1967 | Heller | 138/121 |
| 3,417,785 | * | 12/1968 | Andrews | 138/108 |
| 3,565,118 | * | 2/1971 | Stearns | 138/112 |
| 4,036,617 | * | 7/1977 | Leonard et al. | 138/112 |
| 4,942,905 | * | 7/1990 | Takemae et al. | 138/118 |
| 5,908,288 | * | 6/1999 | Moran | 138/108 |

* cited by examiner

*Primary Examiner*—James Hook
(74) *Attorney, Agent, or Firm*—Thomason, Moser Patterson, L.L.P.

(57) ABSTRACT

A centralizer (101) comprises two annular bands (102, 103) which are spaced apart by a plurality of hollow members (104, 105, 106) extending therebetween. The hollow members (104, 105, 106) overlie openings (110–115; 116–121) in the annular bands (102, 103) respectively. In use, fluid can enter and leave the hollow member via the openings. This flow helps maintain a film of fluid between the annular bands (102, 103) and the tubular on which the centralizer is mounted and thus facilitates rotation of the tubular with respect to the centralizer.

4 Claims, 2 Drawing Sheets

CENTRALIZER

This invention relates to centralizers for use in the construction of oil and gas wells.

During the construction of oil and gas wells a borehole is drilled in the ground. A string of tubulars is then lowered down the borehole and the annular space between the tubulars and the borehole filled with cement.

It is important to ensure that the tubulars are held centrally in the borehole during cementation and it is usual to provide the tubulars with a plurality of centralizers which act between the tubulars and the borehole.

One type of centralizer which is commonly used comprises a pair of annular bands which are spaced apart by a plurality of hollow members which extend therebetween. Such hollow members may extend parallel to the longitudinal axis of the centralizer or may, as disclosed in our co-pending application 96 17789.4, be inclined thereto. The hollow member may be designed to withstand great radial load or to collapse irreversibly when the radial load exceeds a predetermined value. The centralizer may, in use, be secured fast on a tubular, or may be rotatably mounted thereon and retained against significant axial movement by stop collars disposed on the tubular to either side of the centralizer.

This later arrangement is generally used when it is desired to rotate the tubulars during cementation. Rotation is intended to improve the distribution of the cement in the annular space between the tubulars and the borehole and reduce the occurrence of voids when the cement sets. It is desirable that the tubulars should be free to rotate relative to the centralizers and conventionally this has been achieved by the simple expedient of making the inner diameter of the centralizers slightly larger than the outer diameter of the tubular. Although this works to some extent there is still significant friction between the centralizers and the tubulars. If the string of tubulars is sufficiently long the torque which must be applied to the uppermost tubular to ensure rotation of the entire string of tubulars can exceed the maximum torque permitted to be applied to the threaded joints between the tubular which can damage the joints. This is undesirable.

In order to help reduce this problem the present invention provides a centralizer which comprises a pair of annular bands which are spaced apart by a plurality of hollow members, characterised in that each annular band is provided with an opening which underlies a hollow member so that, in use, liquid can flow through the said opening in one of said annular bands, along said hollow member, and out of the opening in the other of said annular bands.

The hollow member may extend substantially parallel to the longitudinal axis of the centralizer or may be inclined thereto, for example at an angle of from 30° to 60°, preferably from 30° to 45° to the longitudinal axis of the centraliser.

The hollow member is preferably of rounded cross-section, although it could be of any convenient shape, for example rectangular or square.

Preferably, the hollow member has a radial inner surface which is substantially flush with the radial inner surface of the annular bands.

Advantageously, the hollow member is tapered towards each end.

Preferably, the hollow member will, in use, substantially permanently collapse against casing when subjected to a lateral load of from 5 to 15 tonnes.

Advantageously, the annular bands are formed in one piece although they could also be made in two separate pieces which can be mounted circumjacent casing.

Preferably, each annular band is provided with a plurality of holes each of which underlies a respective hollow member.

For a better understanding of the present invention reference will now be made, by way of example, to the accompanying drawings in which.

Figure 1:
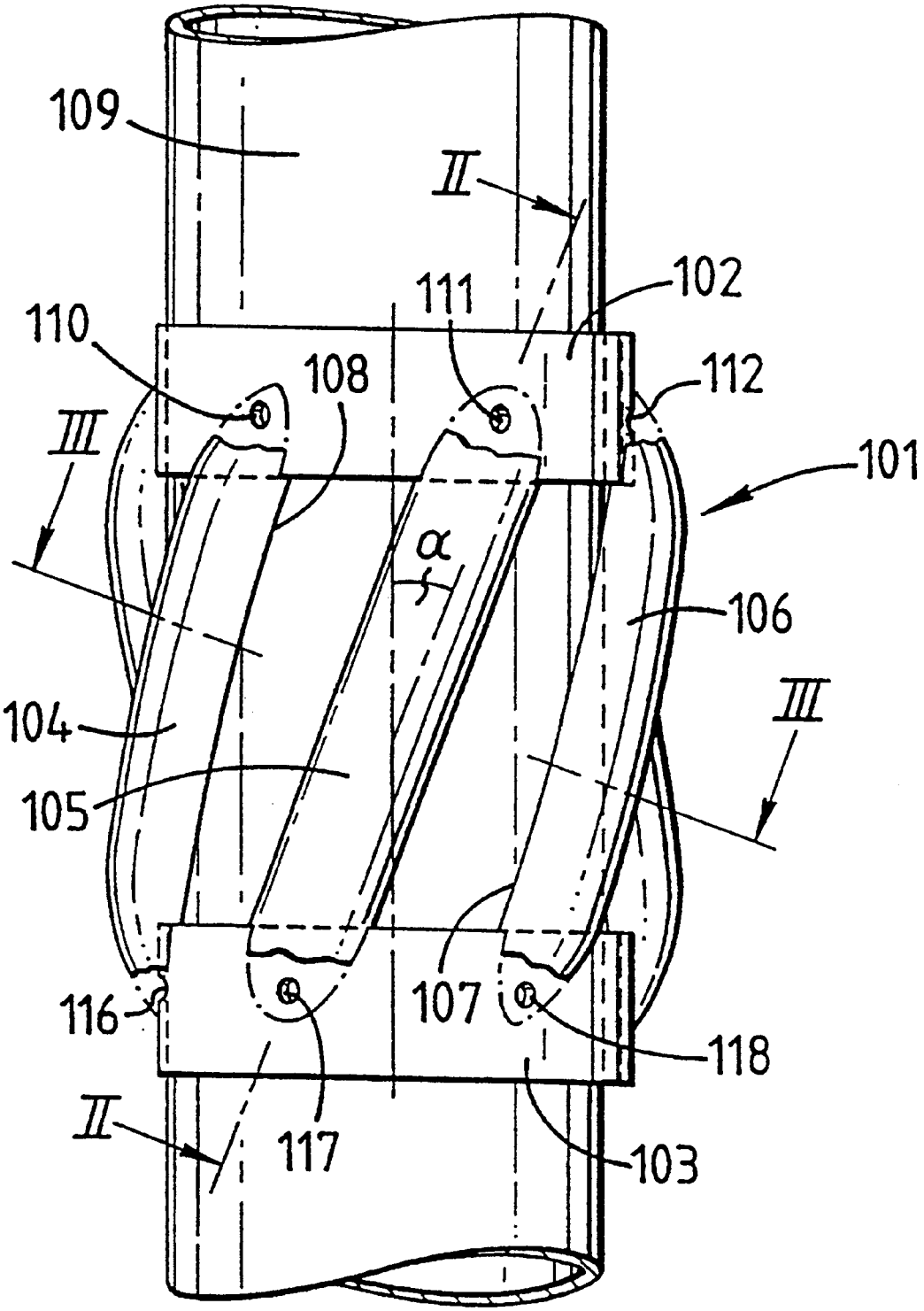
FIG. 1 is a side elevation, with parts broken away, of one embodiment of a centralizer in accordance with the present invention mounted on a tubular.

Referring to the drawings there is shown a centralizer which is generally identified by the reference numeral 101. The centralizer 101 comprises a pair of annular bands 102, 103 which are spaced apart by six hollow members, three of which 104, 105, 106 are visible in FIG. 1.

Each hollow member 104, 105, 106 is inclined at an angle a of from between 30° to 60° and preferably from about 30° to 45° to the longitudinal axis of the centralizer 101.

Each hollow member 104, 105, 106 has skirt portions 107, 108 which extends radially inwardly and finishes flush with the radially inner surface of the two annular bands 102 and 103.

In use, the centralizer 101 is slid over a tubular 109. The centralizer 101 is secured in position by stop collars (not shown) placed above and below the centralizer 101.

Each hollow member 104, 105, 106 comprises a thin sheet of steel which is about 3 mm in thickness and is shaped into a curve. Each hollow member 104, 105, 106 is also tapered both radially and circumferentially towards each end to facilitate movement of the centralizer 101 in the borehole.

As can be seen in the Figures each annular band 102, 103 is provided with six openings. Thus annular band 102 is provided with openings 110, 111, 112, 113, 114 and 115 whilst annular band 103 is provided with openings 116, 117, 118, 119, 120 and 121. It will be noted that each opening underlies a respective member. Thus opening 111 underlies the upper end of member 105 whilst opening 117 underlies the lower end of the same member 105.

In use, a plurality of centralizers similar to centralizer 101 are rotably mounted between stop collars on a string of casing which is then lowered down a borehole. When the casing is in place circulating fluid is pumped down the annular space between the casing 122 and the tubular 109 and then travels to the surface via the inside of the tubular 109.

Figure 2:
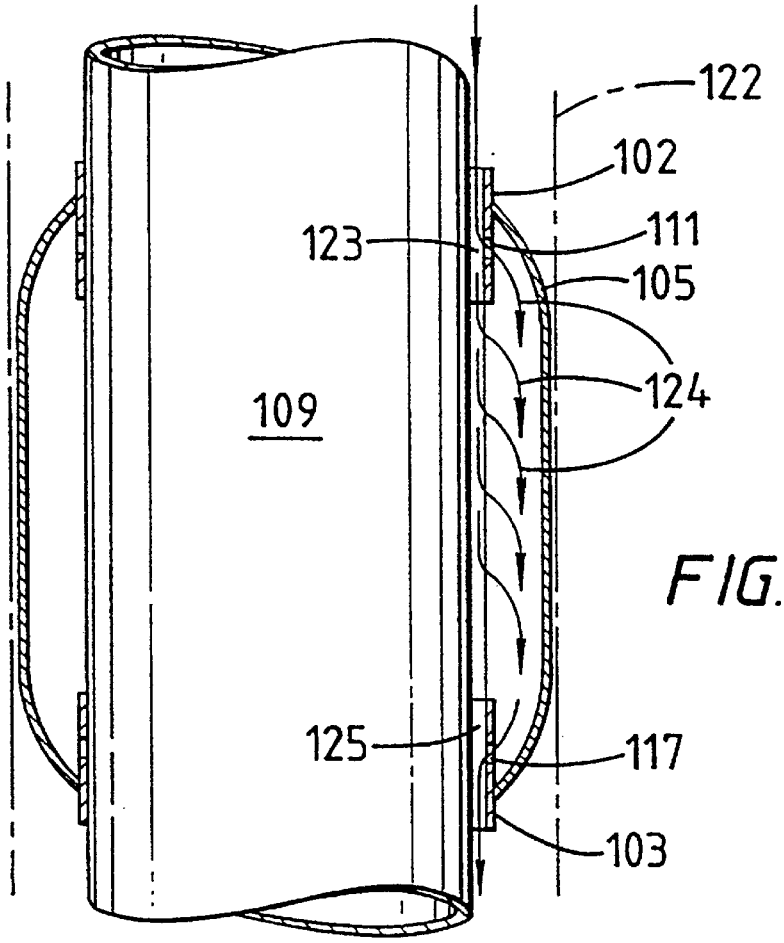
FIG. 2 is a section taken on line II—II of FIG. 1.
Figure 3:
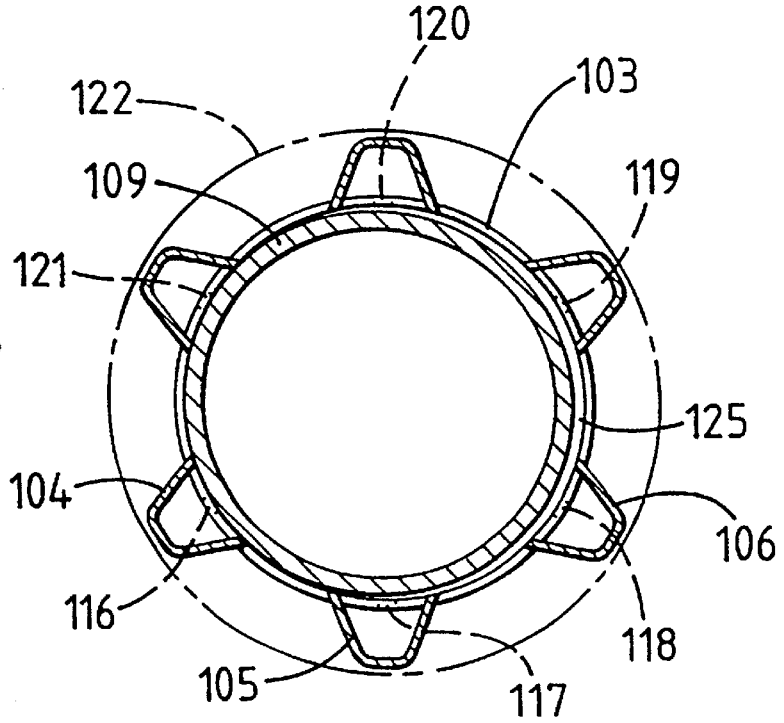
FIG. 3 is a section taken on line III—III of FIG. 1.

As the circulating fluid passes each centralizer 101 the majority passes between adjacent hollow members 104, 105, 106. As the circulating fluid passes downwardly over the annular band 102 between the hollow member 104, 105, 106 it is diverted sideways. As it passes over the upper edge of the annular band 103 a turbulent rolling action is initiated which is amplified as the circulating fluid passes over the annular band 103. The combined swirling and rolling action provides an extremely effective clearing and scouring action which is highly desirable. However, part of the circulating fluid passes through the clearance 123 between the annular band 102 and the tubular 109. Thus as can be seen from the arrows 124 in FIG. 2, part of the flow enters the inside of the member 105 via the opening 111 whilst another part enters the member 105 after emerging from the clearance 123. The flow passes along the inside of member 105 before passing through opening 117 into clearance 125.

If the string is rotated the annular bands 102, 103 ride on a film of circulating fluid which helps avoid metal to metal contact between the annular bands 102, 103 and the casing. This in turn reduced the friction therebeween.

After the annular space between the casing 109 and the borehole has been prepared cement is pumped down the casing and up into the annular space while the casing is rotated. The cement is then allowed to set in the conventional manner.

Occasionally, part of the borehole will collapse when running casing. The usual procedure when this occurs is to withdrawn the casing, make good the problem as necessary and reinsert the casing. Although the casing can usually be withdrawn without too much difficulty the forces imposed on traditional centralizers often result in their disintegration with the result that broken parts of centralizers remain in the borehole. This is most undesirable. Applicants PCT Publication No. WO 96/09459 addresses this problem by providing a centralizer with members which have sufficient strength to centralize the casing but which will collapse if withdrawn through a relatively rigid constriction. The underlying principle is that it is better to replace a permanently deformed centralizer at the surface rather than to leave parts of a disintegrated centralizer in the borehole. Typically, the members should substantially irreversibly collapse when subjected to a lateral load of from 5 to 15 tonnes with 11 tonnes being currently used for design purposes for most occasions.

What is claimed is:

1. A centralizer (101) comprising a pair of annular bands (102, 103) which are spaced apart by at least one hollow member (104, 105, 106), wherein each of the annular bands (102, 103) is provided with an opening (110–112; 116–121) which underlies a hollow member (104, 105, 106) that is inclined to a longitudinal axis of the centralizer, so that fluid can flow through the opening in one of the annular bands (102), within the hollow member, and out the opening in the other of the annular bands.

2. A centralizer for a wellbore tubular comprising: a pair of annular bands which are spaced apart by at least one hollow member inclined to a longitudinal axis of the centralizer, each of the annular bands provided with an opening which underlies a hollow member so that in use, a fluid can flow through the opening in one of said annular bands within said hollow member, and out of the opening in the other of said annular bands, the centralizer rotationally independent of the wellbore tubular.

3. The centralizer of claim 2, wherein the inclination of the hollow member to the centralizer is from 30 to 60 degrees.

4. The centralizer of claim 2, wherein the inclination of the hollow member to the centralizer is from 30 to 45 degrees.

* * * * *

UNITED STATES PATENT AND TRADEMARK OFFICE

CERTIFICATE OF CORRECTION

PATENT NO. : 6,298,883 B1
DATED : October 9, 2001
INVENTOR(S) : Kinzel

It is certified that error appears in the above-identified patent and that said Letters Patent is hereby corrected as shown below:

Title page,
ABSTRACT, line 6, please replace "via" with -- via *inter alia* --.

Column 2,
Line 26, please replace "a" with -- ∝ --.

Column 3,
Line 23, please replace "withdrawn" with -- withdraw --.

Signed and Sealed this

Ninth Day of April, 2002

*Attest:*

*Attesting Officer*

JAMES E. ROGAN
*Director of the United States Patent and Trademark Office*